United States Patent [19]

Logas

[11] Patent Number: 4,643,005

[45] Date of Patent: Feb. 17, 1987

[54] MULTIPLE-BOLT LOCKING MECHANISM FOR SLIDING DOORS

[75] Inventor: Duane K. Logas, San Bernardino, Calif.

[73] Assignee: Adams Rite Manufacturing Co., City of Industry, Calif.

[21] Appl. No.: 699,847

[22] Filed: Feb. 8, 1985

[51] Int. Cl.[4] ..... E05B 65/08

[52] U.S. Cl. ..... 70/95; 70/99; 70/116; 70/139; 292/5; 292/8; 292/26; 292/48; 292/DIG. 46

[58] Field of Search ..... 70/95, 99, 100, 114, 70/115, 116, 139; 292/4, 5, 8, 11, 26, 29, 48, 52, 196, 200, DIG. 46, DIG. 66, 97, 100

[56] References Cited

U.S. PATENT DOCUMENTS

| | | | |
|---|---|---|---|
| 2,989,859 | 6/1961 | Eads | 70/116 |
| 4,239,268 | 12/1980 | Rider | 292/DIG. 46 |
| 4,445,717 | 5/1984 | Imhoff | 292/DIG. 46 |
| 4,514,996 | 5/1985 | Sjogren | 292/DIG. 46 |

FOREIGN PATENT DOCUMENTS

| | | | |
|---|---|---|---|
| 518370 | 2/1931 | Fed. Rep. of Germany | 292/5 |
| 2043762 | 10/1980 | United Kingdom . | |
| 2101667 | 1/1983 | United Kingdom . | |
| 2119014 | 11/1983 | United Kingdom . | |
| 2125876 | 3/1984 | United Kingdom . | |
| 2136045 | 9/1984 | United Kingdom . | |

*Primary Examiner*—Robert L. Wolfe
*Attorney, Agent, or Firm*—Whann & McManigal

[57] ABSTRACT

A multiple-bolt locking mechanism particularly for use with sliding doors having a narrow stile frame movable into closed engagement with a tubular thin walled jamb frame structure and which comprises a vertically spaced upper main locking unit on the door narrow stile frame having a hook-type bolt actuatable by a key mechanism between an unbolted position and a dead-locked bolted position, a lower slave lock unit on the door narrow stile frame having a hook-type bolt, and a upper slave header locking unit, having a longitudinally reciprocable bolt for bolting engagement with door frame header keepers respectively at a door fully closed position and a door partially open position. The hook-type bolts are each movable into hooked bolted relation with a relatively thin wall portion of the jamb wall surrounding a bolt receiving opening therein and which is peripherally reinforced by being sandwiched between an associated inner backup steel plate member and an outer trim steel plate member. The header bolt is spring biased towards a fully projected normal position for operatively entering a receiving opening of a header keeper when the door is in fully closed position or in a partially open position, but is movable against the biasing spring to a retracted position upon failure of the bolt to enter the bolt receiving opening of an associated header keeper due to misalignment or upon engagement with an adjacent header surface.

5 Claims, 8 Drawing Figures

MULTIPLE-BOLT LOCKING MECHANISM FOR SLIDING DOORS

BACKGROUND OF THE INVENTION

The present invention relates generally to the field of locks for doors that are mounted for movement into closed and open positions with respect to a door jamb.

It has been known generally from U.S. Pat. Nos. 2,854,839 and 2,989,859 to provide for a lock mechanism of the swinging bolt type for mounting in the narrow stile of a door and which utilizes a key-actuated lock cylinder assembly of the casement type, and which is threadedly secured to a side plate of the lock mechanism casing. In this type assembly, the rotatable cam extension is of relatively thin material and is arranged to operatively engage abutment means and detent means on one side only of an elongated actuating lever that is pivoted at one end for swinging movement and has its other end connected by a pin and slot connection to the inner end of a swingable bolt. The cam extension is positioned between the ends of the actuating lever, and the lever as arranged requires a relatively long throw to actuate the bolt.

It is also known from a later U.S. Pat. No. 3,899,906 to provide an improved and modified component arrangement of the above noted patents so as to obtain a simplified mechanism, yet one having improved operating characteristics, and which will provide greater security. Briefly, this is accomplished by utilizing a key-actuated lock cylinder assembly of the inert type having a cam extension of considerably increased thickness, and which can be symmetrically positioned at one end of a rocker lever, the other end of the lever being connected to the inner end of the pivotally swingable bolt. This lever arrangement produces a relatively short bolt operating throw and has the advantage that the end associated with the cam extension can be provided with integrally formed spaced end abutment projections so as to operably centrally straddle the cam extension in a manner to apply operating forces in the actuating plane of the lever.

More recently it has been generally known to utilize a locking mechanism having multiple bolts, as exemplified by U.S. Pat. No. 4,368,905, for swinging door installations. This patent discloses a locking arrangement in which top and bottom bolts are located at the upper and lower ends of a narrow stile swinging door frame, and wherein the bolts are connected with a bolt actuating mechanism by means activating linkages having telescoped length adjustable elements. In this patent, dogging means for dogging the top bolt is also operative to dog a bottom bolt.

In accordance with the features of the present invention, it is proposed to provide an improved multiple-bolt locking mechanism which is particularly advantageous for use in sliding aluminum door structures to provide greater security and make forced entry more difficult. This is accomplished by mounting on the door stile a vertically spaced upper main locking unit having a hook-type bolt actuated by key means between an unbolted position and a bolted dead-locked position, and a lower slave locking unit having a hook-type bolt connected to and being simultaneously operable by the bolt of the upper main locking unit between a corresponding unbolted and bolted position in which it will be dead-locked by virtue of the dead-locking mechanism of the upper main locking unit.

A further important feature comprises the provision of a unique spring biased header bolt which is also connected to and simultaneously operable by the bolt of the upper main locking unit between an unbolted position and bolted position for coaction with header strike keepers for locking the sliding door in fully closed and partially open positions. The use of a spring biased header bolt enables movement of the hook-type bolts into fully bolted positions, even though the header bolt fails to move into a bolted position with an associated header keeper.

SUMMARY OF THE INVENTION

The present invention is more specifically concerned with improvements in locking mechanisms for sliding doors and more particularly with respect to multiple-bolt mechanisms for securing the sliding door in fully closed and partially open positions.

It is one object of the present invention to provide a unique multiple-bolt locking mechanism for sliding door installations in which the actuating means and dead-locking means associated with one of the multiple-bolts will be effective with respect to all of the bolts.

A further object is to provide a multiple-bolt locking mechanism for a sliding door in which hook-type swingable bolts are utilized to secure the door in a fully closed position and a longitudinally reciprocable header bolt means which not only coacts with the hook-type bolts to secure the door in fully closed position, but is also operable to secure the door in a partially open position to provide flow-through ventilation.

A further object is to provide a multiple-bolt locking mechanism which includes a longitudinally reciprocable header bolt that is operable between an unlocked position and a locked position with a header keeper having an opening for the endwise reception of the bolt therein, and in which said bolt is further supported by independent movement from a normal operative position to a retracted position against a biasing spring means in the event that the bolt does not enter the header keep opening and engages a surface adjacent the entrance of the keeper opening during a locking movement.

Another object is to provide a multiple-bolt locking mechanism for a sliding door in which a hook-type swingable bolt at a door closed position is movable into a bolted position with cam improved keeper structure including an opening in a relatively thin wall of a door jamb formed from a relatively easily bendable metal such as aluminum which includes an inner steel back plate and an outer steel trim plate to reinforce the wall area surrounding the bolt receiving opening.

Further objects of the invention will be brought out in the following part of the specification, wherein the detailed description is for the purpose of fully disclosing the invention without placing limitations thereon.

BRIEF DESCRIPTION OF THE DRAWINGS

Referring to the accompanying drawings, which are for illustrative purposes only.

DESCRIPTION OF A PREFERRED EMBODIMENT

Figure 1:
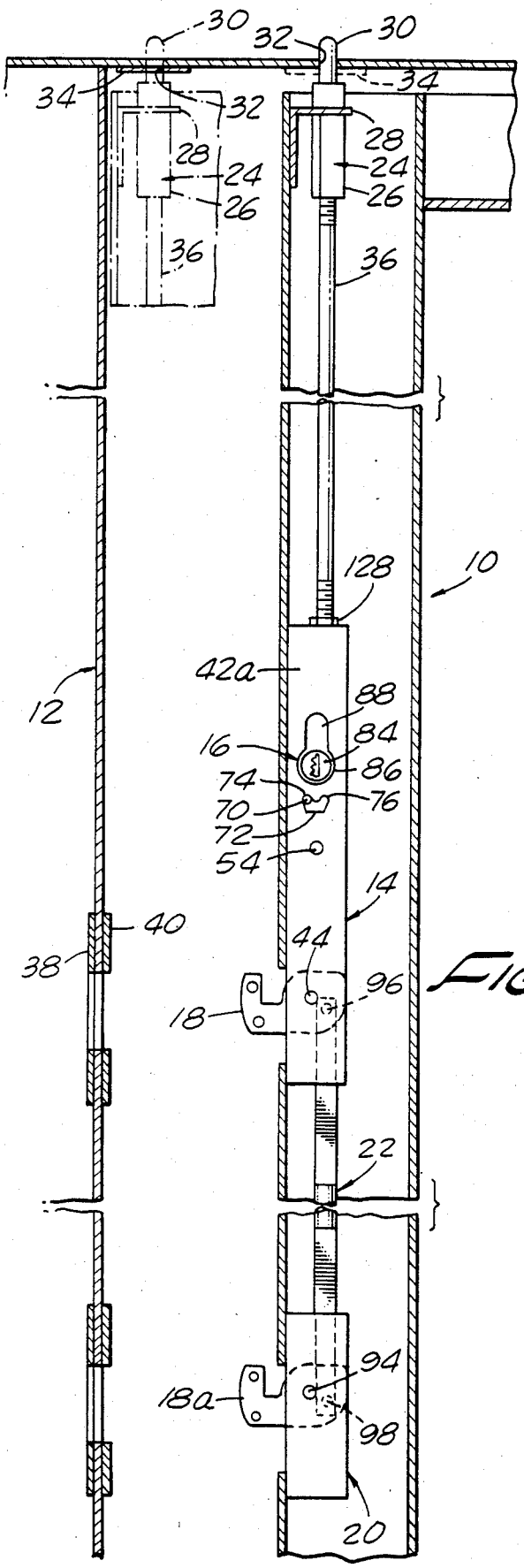
FIG. 1 is an elevational view diagramatically illustrating a multiple-bolt locking mechanism for a sliding door according to the present invention, together with an associated door jamb.

Referring more specifically to the drawings, for illustrative purposes the locking mechanism of the present invention is generally disclosed in FIG. 1 as being mounted on a stile 10 of a sliding door frame which is movable into closed and open positions with respect to a door jamb structure 12.

The locking mechanism includes a main upper locking unit 14 is actuatable by key-controlled means 16 to actuate a hook-type bolt 18 between a retracted unbolted position and an extended bolted position, and in which the bolt will be dead-locked in the bolted position.

A lower locking unit 20 contains a second hook-type bolt 18*a* which is coupled by means of a link 22 to the bolt 18 for operation of a "slave" unit. As thus connected, the bolt 18*a* in its extended position will be dead-locked by virtue of the dead-locking means of the main locking unit 14.

An upper locking unit 24 comprises a housing 26 which is vertically reciprocal in a guide bracket 28 at the top of the door, the housing mounting a spring-biased header bolt 30 which is arranged to be impelled into an extended operative position for endwise insertion into a locking position, but may be withdrawn from the keeper into a non-locking position, when the housing 26 is moved to a retracted position. Movements of the housing 26 are effected through a length adjustable connecting link 36 with the mechanism of the main locking unit 14, so that when the bolts 18 and 18*a* are in a locked position, the housing 26 will be in a raised position. In the event that the bolt 30 is not properly aligned with the opening in the header strike, as frequently may happen due to misalignment, warping and the like, it will not prevent the movement of the hook bolts 18 and 18*a* into their extended bolting positions. Shaking or slight door movement will generally permit the bolt 30 to move into its biased locking position with the header strike. As will be seen, in addition to the provision of a header strike keeper at the door closed position, a header strike may be positioned so as to lock the door in a partially open position to provide desirable flow-through ventilation, and yet provide required security in the limited open position of the door.

The hook-bolts in a closed position of the door are arranged to respectively engage a strike forming structure that includes an inner steel back plate 38 and an outer steel trim plate 40 between which the relatively thin aluminum wall of the door jamb 12 is sandwiched, thus resulting in the formation of a strike structure of materially increased strength and providing greater security.

Figure 2:
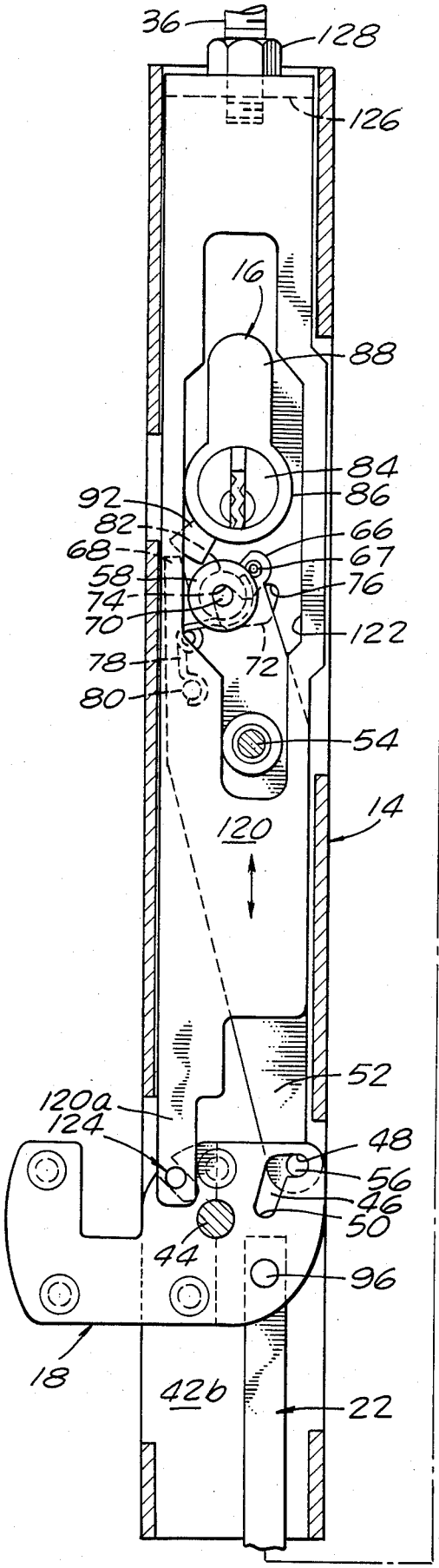
FIG. 2 is an enlarged transverse sectional view taken through the cases of the main upper locking unit and the lower locking unit and showing the cooperative relationship of the components of the locking means for the jamb bolts, the bolts being in an extended locked position.
Figure 2:
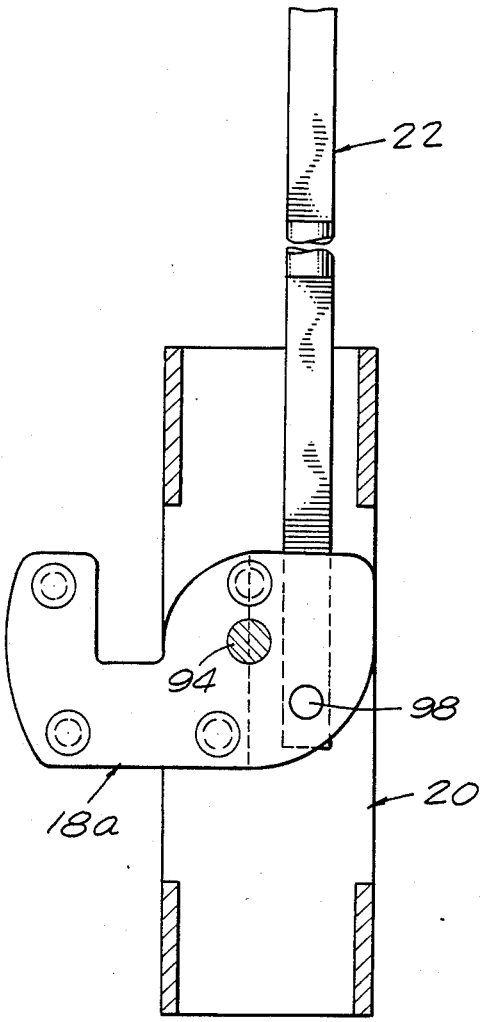
Figure 3:
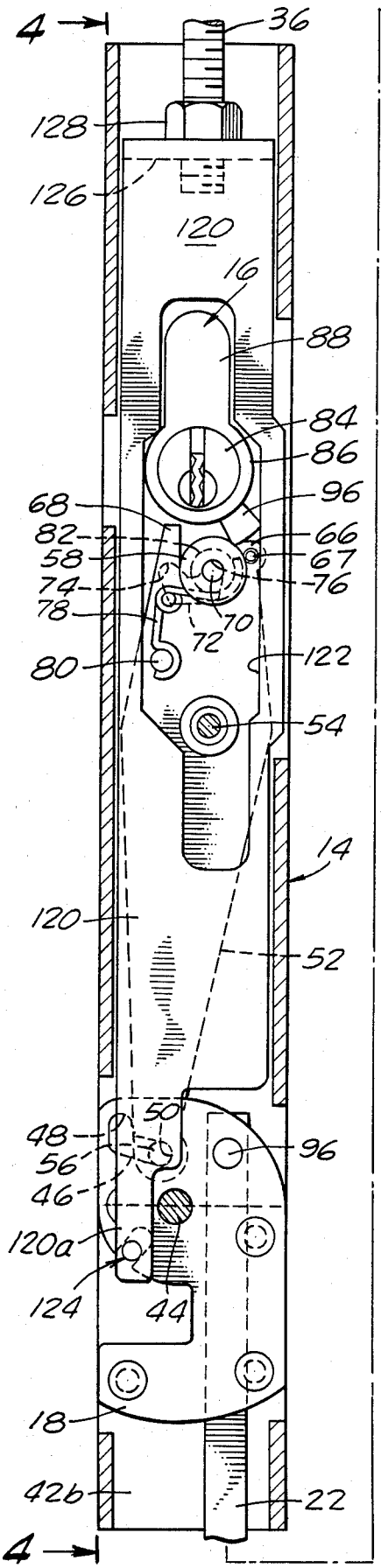
FIG. 3 is a view similar to FIG. 2, except that the bolts are shown in retracted unlocked positions.
Figure 3:
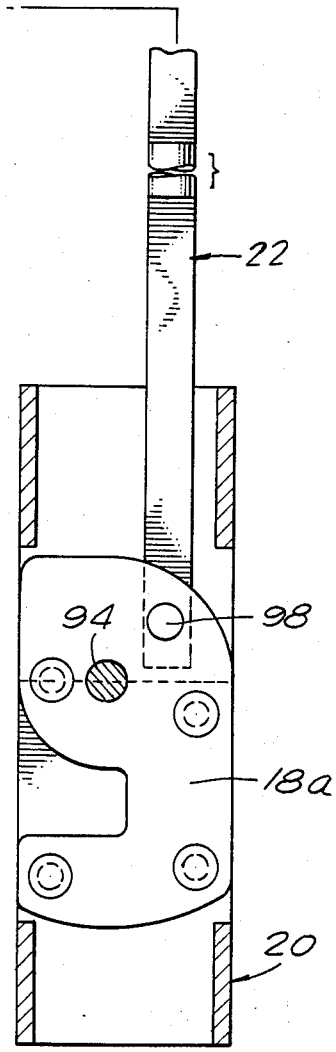

For a better understanding of the present invention, the operative components of the main upper locking unit 14 will now be specifically described, reference being made particularly to FIGS. 2 and 3, wherein the components are shown as being mounted between spaced side walls 42*a* and 42*b* of a conventional case.

The bolt 18 is shown as being laminated and pivotally mounted for swinging movements through an angle of substantially 90° between its extended and retracted positions, a pivot pin 44 extending through the inner end of the bolt and having its opposite ends rigidly supported in the side walls 42*a* and 42*b*, respectively. The inner end of the bolt is constructed to provide transversely aligned L-shaped slots 46 having dwell positions at its ends as indicated by the numerals 48 and 50, respectively. The slots are oriented so that the long leg extends in a direction generally transversely of the bolt, while the short leg of the slot is more nearly aligned with the longitudinal axis of the bolt.

The bolt 18 is actuated between its retracted unlocked position and extended locked position by means of an acutating rocker lever 52 which extends longitudinally of the case and is supported between its ends on a pivot 54 for rocking movement. One end of the rocker lever 52 extends into a space at the inner end of the bolt and carries a transversely extending pin 56 having its ends respectively positioned on opposite sides of the lever and extending into the bolt L-shaped slots 46,46 for movement therein. The rocking movement of the rocker lever 52 is thus constrained, and the slot 46 is so shaped as to accommodate relative movements of the pin and bolt during operative movements of the rocker lever in moving the bolt between its retracted and extended positions.

Figure 4:
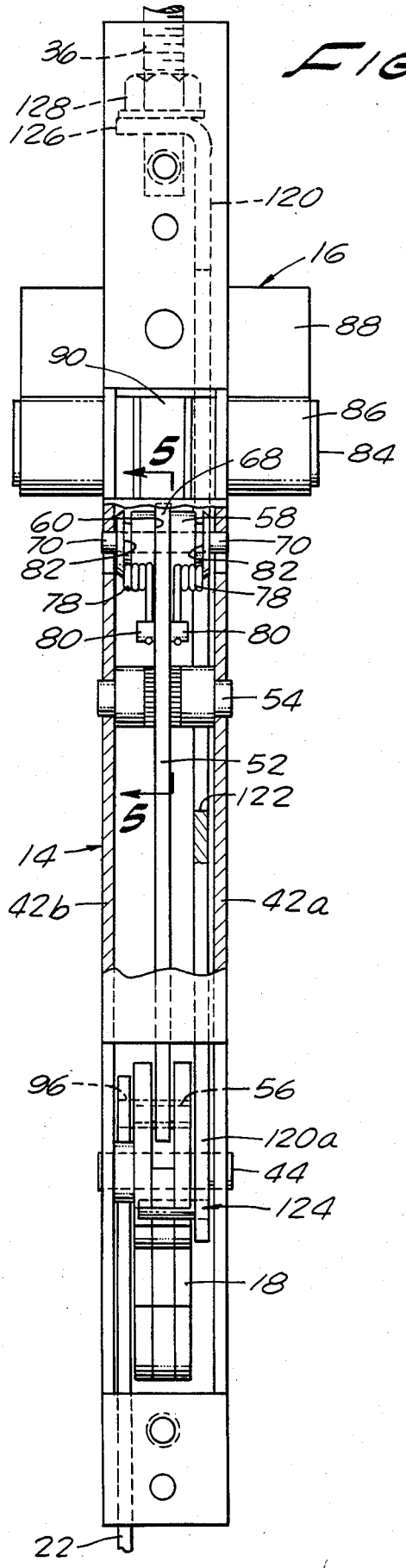
FIG. 4 is an enlarged longitudinal sectional view, taken substantially on line 4—4 of FIG. 3, and showing details of the key-actuated locking means of the main upper locking unit.
Figure 5:
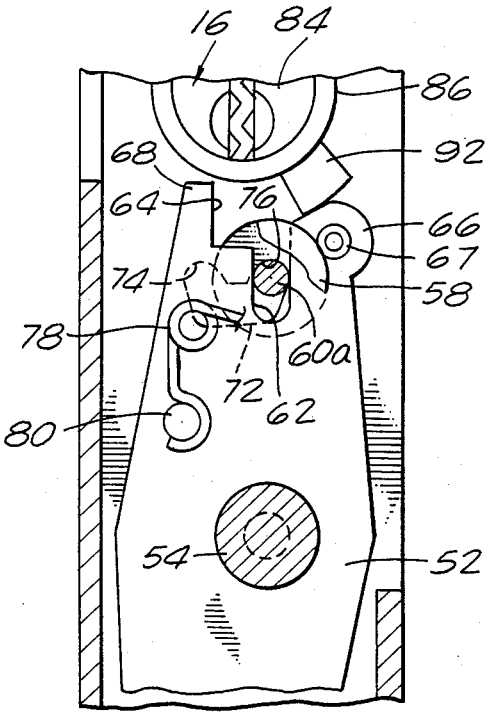
FIG. 5 is an enlarged fragmentary sectional view, taken substantially on line 5—5 of FIG. 4, and showing details of the mounting for the cam roller detent at the upper end of the actuating rocker lever.

Provisions are made for positively releasably latching the bolt 18 in its retracted position and its extended position. This is accomplished by detent means associated with the other end of the rocker lever 52, which includes a cam roller 58, as best shown in FIGS. 4 and 5. The cam roller is provided with a circumferentially extending groove 60 intermediate its ends, which forms a portion 60*a* of reduced diameter that is slidably movable within an inner end portion 62 of an end opening generally T-shaped slot (FIG. 5) as provided in the other end of the rocker lever 52. An outermost end portion 64 of the slot is of increased width an provides an end opening space which separates integrally formed end projections 66 and 68 that lie on opposite sides of the cam roller 58.

The outermost ends of the roller 58 are formed to provide axially extending end projections 70, 70 of reduced diameter, and which are respectively positioned for movement in arcuate slots 72, respectively, formed in the side walls 42*a* and 42*b* of the case. Each slot 72 has dwell notches 74 and 76, respectively, at its ends. Before final assembly of the rocker lever 52 and the associated cam roller 58 into the case, the cam roller is retained against removal from the inner end portion 62 of the T-shaped slot by means of a detent pin 67 mounted on the end projection 66.

As shown in FIGS. 4 and 5, the cam roller 58 normally extends into the space of the slot end portion 64 between the end projections 66 and 68 and is biased in an outward direction in the slot by means of a coiled spring 78 placed on each side of the rocker lever 52, one end of the coiled spring being secured to an anchor pin 80 carried by the rocker lever and the other end of the spring bearing against and being seated in a circumferentially extending groove 82 formed in the end portion of the cam roller 58. With this arrangement, the roller end projections 70,70 will be biased in the dwell notches 74,74 so as to form a latching detent and dead-lock the bolt 18 in its extended locked position, and into the dwell notches 76,76 in the retracted unlocked position of the bolt.

Various manually operable means may be utilized for motivating rocking movement of the rocker lever 52, and with the locking means disclosed herein the rocker lever may be arranged for actuation by means of a conventional lock cylinder from either or both sides of the door. For illustrative purposes, the key-controlled means 16 as utilized in the present invention is shown as containing a conventional lock cylinder 84 which is preferably of the insert type rather than the casement type that is threadedly mounted on a wall of the case of the locking means. The insert type is readily available in a form that is accessible for operation from one side of the door or a form that is operable from both sides of the door. As shown, the lock cylinder 84 has a body structure of generally keyhole configuration with a cylindrical portion 86 and a radially extending projecting portion 88. The body structure is insertable endwise through appropriate aligned keyhole-shaped openings, respectively, formed in the side walls **42*a* and 42*b*** of the case.

The lock cylinder assembly includes in its cylindrical body portion 86, a rotatable member 90 which carries a radially projecting cam extension 92 arranged to pass through an opening in the body portion during movement from one side to the other of the assembly body. The cam extension 92 is of a width such that it will engage opposite end portions of the cam roller 58 during its rotative movement. The cam extension 92 thus serves the dual purpose of initially releasing the latching detent and thereafter shifting the rocker lever from one of its latched positions to the other so as to motivate the bolt 18 from one operative position to the other. The bolt 18 is therefore positively latched or dead-locked in its extended position. Should it be desired to move the bolt to its retracted position, the cam extension 92 would be rotated in a reverse direction. It will be seen that the projections 66 and 68 are so oriented that the outermost end of the cam extension will pass the projection 68 and move into engagement with the cam roller 58. Continued movement of the cam extension will cause it to force the roller from its latching position and move it into a position which permits the cam extension to pass through the slot end portion 64 into abutting engagement with the projection 66 and apply a force which will now shift the rocker lever 52 to the position shown in FIG. 3. In this position, the bolt 18 will be in a retracted position, and the pin 56 will have moved into the dwell position 50 of the slot 46. In this position of the rocker lever, the cam roller 58 will be biased outwardly so that its end projections 70 will now be seated in the dwell notches 76,76, as the rotation of the cam extension continues. In this position of the rocker lever, it will be observed that the end projection 66 has now assumed a position which will permit the end of the cam extension to pass by and continue in its rotative movement. The action of the components of the locking means will be similar to that just described, except in reverse order, when rotating the cam extension in a reverse direction so as to motivate the bolt 18 to its extended locked position as shown in FIG. 2.

The lower locking unit 20 in a similar manner to that shown for the main upper locking unit 14 mounts a hook-type bolt **18*a* for swinging movements by means of a pivot pin 94 which extends through the inner end of the bolt and has its opposite ends rigidly supported in spaced apart side walls of a conventional case. In order to obtain unitary movement of the bolt 18 and 18*a*, these bolts are innerconnected by the link 22 which is connected by a pivot pin 96 with the inner end of the bolt 18, and by means of a pivot pin 98 with the inner end of the bolt 18*a***.

Figure 6:
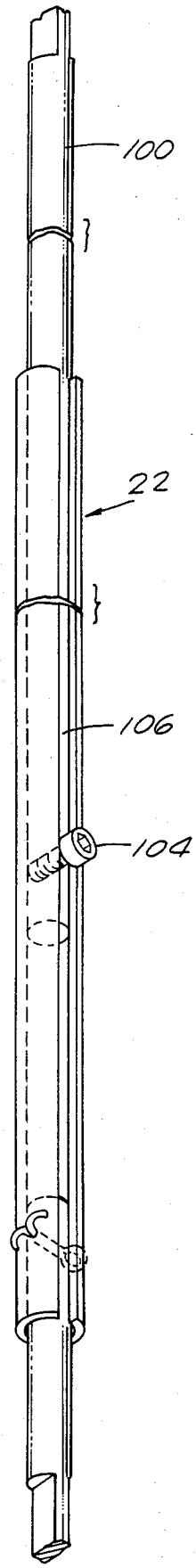
FIG. 6 is a perspective view of the link for operatively interconnecting the jamb bolts of the main upper locking unit and the lower locking unit, and showing details of its length adjusting means.

Preferably, the line 22 is length adjustable in order to obtain the best possible operation for a particular installation. As best shown in FIG. 6, the link 22 comprises a rod section 100 which is connected at one end with the bolt 18 and a longitudinally slit tubular rod section 102 which is connected at one end with the bolt **18*a*. The opposite ends of the rod sections 100 and 102 are connected in telescopic longitudinally adjustable relation. However, in order to assure that the desired adjusted relationship is retained, provision is made for permanently interconnecting the rod sections 100 and 102 in a manner to prevent axial telescoping movement between the sections. For this purpose a screw 104 is mounted in a transversely extending diametral threaded bore of the rod section 100 and has its threaded shank portion positioned in the longitudinally extending slit 106 of the tubular rod section 102**, whereupon tightening of the screw will force its other end through the adjacent wall of the tubular rod section and permanently bind the sections against axial movement.

Figure 7:
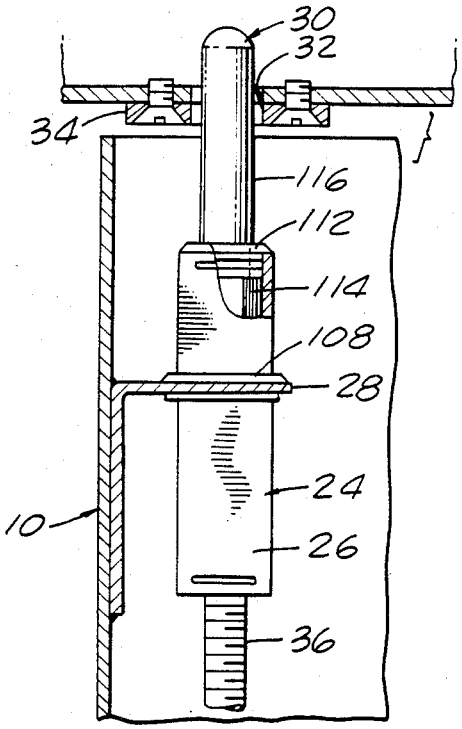
FIG. 7 is an enlarged fragmentary elevational view of the header bolt structure, and showing details of its mounting means, the bolt being in an extended locked position.
Figure 8:
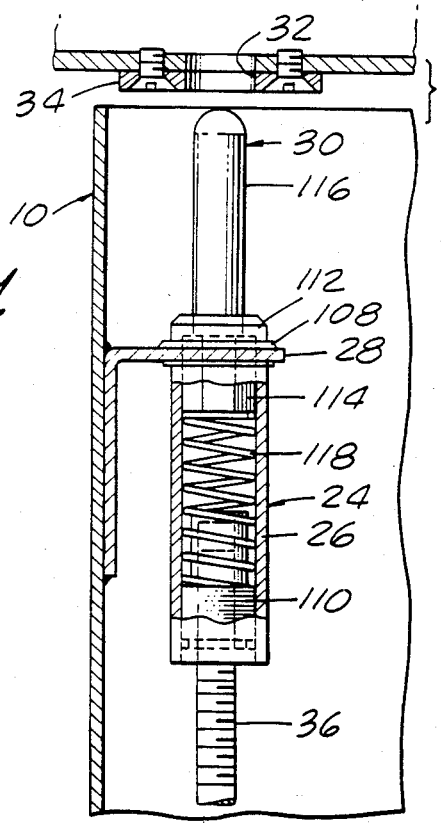
FIG. 8 is a view similar to FIG. 7, but including a portion in section to disclose details of the bolt biasing spring means, the bolt structure being in a retracted unlocked position.

Having reference to FIGS. 7 and 8, the upper locking unit 24 is shown as comprising a housing 26 formed by an elongate square tubular sleeve which is supported for longitudinal reciprocable movements by means of the L-shaped bracket 28, such movement being preferably guided by means of a guide bushing 108. The lowermost end of the tubular housing 26 is closed by an end plug 110, and the upper end of the housing sleeve 26 is closed by an annular end cap 112 which provides a support for axial longitudinal movement therein of the header bolt 30. This header bolt 30 is formed with a head portion 114, which is shown as being of octagonal peripheral configuration, and an elongate cylindrical shank portion 116 which is preferably rounded at its outer end. This bolt is operatively mounted with its head portion within the housing sleeve 26 and with its shank portion 116 projecting through the end cap 112. A coiled compression spring 118 is mounted within the sleeve housing and has a lower end portion which surrounds and is anchored by an adjacent end portion of reduced diameter formed on the plug 110. The other end of the spring 118 bears against the head portion 114 and thus serves to resiliently bias the bolt 30 into a normal operative position in which it axially projects from the uppermost end of the housing 26 and with which it has unitary movement during longitudinal movements of the housing 26 in response to operations of the main locking unit 14. As thus arranged, however, it will be apparent that the bolt 30 may be independently moved from its fully extended position to a retracted position against the biasing action of the spring 118.

It will be appreciated that the motion transmitting connection between the bolt 18 and housing sleeve 26 may vary widely as to specific details, but in the present invention is shown as comprising an elongate plate member 120 which is supported by appropriate guide means for longitudinal reciprocal movement within the case for the main locking unit 14, this plate member having an elongate cutout window or slot portion 122 for straddling the key control means 16, the cam roller 58 and the pivot 54 as well as any other components of the mechanism which would interfere with the required longitudinal operating movements of the plate member. As shown in FIGS. 2, 3 and 4, the plate member 120 is provided at one end with a projecting end portion 120*a* which is connected by a pin and slot connection 124 with the bolt 18 in such a manner that the rotative movements of the bolt will impart longitudinal axial movements to the plate member 120. The opposite end of the plate member 120 is formed with a right-angle end portion 126. As shown in FIG. 4, the end portion 126 is threadedly connected with a threaded end of connecting link 36, the opposite end of the link 36 being threadedly connected with the end plug 110 (FIG. 8). Thus, the threaded connections at the opposite ends of the connecting link 36 provide means for effecting length adjustments of the connected linkage and such adjustments may be permanently fixed by means of a lock nut 128 which can be tightened against the right-angled end portion 126 so as to retain the connecting link 36 against rotative movements.

As best shown in FIGS. 1,7 and 8, the header bolt 30 is arranged to lock the door in fully closed or partially opened positions by being operatively inserted endwise into a header keeper 34 in the form of a flat plate having a bolt receiving opening 32. It will be appreciated from the foregoing description of the construction and operation that the biased bolt 30 in the event of any inadvertent misalignment of the bolt with the opening 32 which would result in the engagement of the outer end of the bolt with the keeper or engagement of the outer end of the bolt with the header surface, the bolt will be permitted to independently move to a retracted position within the housing sleeve 26 a sufficient distance to obviate possible interference with the movement of the bolt 18 to its extended locked position.

It is to be understood that the cases of the main locking unit 14, the lower locking unit 20 and the guide bracket 28 may be secured to adjacent wall portions of the narrow stile 10 in their respective required operative positions by means of appropriate mounting screws or other well known conventional means.

From the foregoing description, it will be apparent that the multiple-bolt locking mechanism as described herein accomplishes the stipulated objects and features as set out for the invention.

Various modifications may suggest themselves to those skilled in the art without departing from the spirit of my invention, and, hence, I do not wish to be restricted to the specific form shown or uses mentioned except to the extent indicated in the appended claims.

I claim:

1. A multiple-bolt locking mechanism for a door having a vertical stile slidably movable into and out of closed engagement with a vertical door jamb;

vertically spaced upper and lower hook-type bolts supported on said door stile for movement to locked and unlocked positions with respect to said door jamb, when in said closed engagement;

means interconnecting said bolts concerted movements to said locked and unlocked positions;

key-controlled means operatively connected with one of said hook-type bolts for selectively actuating it to said locked and unlocked positions;

dead-bolt locking means operatively connected with one of said hook-type bolts; and header bolt means connected for reciprocal actuation by said key-controlled means into locked and unlocked positions respectively with door frame header keepers at door closed and door partially open positions.

2. A multiple-bolt locking mechanism according to claim 1, wherein the header bolt means comprises:

an elongate tubular sleeve housing supported adjacent the top edge of the door for axial longitudinal reciprocable movements;

an elongate header bolt member supported in the upper end of said housing for relative longitudinal axial movements between extended and retracted projecting limit positions;

spring means in said housing for biasing said header bolt member in a direction towards its extended projecting limit position; and an actuating link connected between said housing and one of said hook-type bolts operable to axially move said housing and header bolt member as a unit in response to operative movements of the hook-type bolts.

3. A multiple-bolt locking mechanism according to claim 2, in which:

the header bolt member is so conformed and mounted that inadvertent engagement thereof with a surface in its path of movement during a locking operation will produce a relative retractive movement thereof and enable unimpeded movement of the hook-type bolts to their fully locked positions.

4. A multiple-bolt locking mechanism according to claim 1, wherein:

length adjustable actuating links respectively connect the hook-type bolts, and one of the hook-type bolts with the header bolt means for operation in response to its movements.

5. A multiple-bolt locking mechanism according to claim 1 in which:

said vertical door jamb is a tubular member and has an outer facing wall formed with elongate keeper forming openings for respectively receiving the hook-type bolts in the door closed position upon movement thereof to their extended locking positions, and an inner steel backup plate member and an outer steel trim plate member are secured together in surrounding relation to each of said keeper wall openings and coact to reinforce the peripheral wall area surrounding said keeper wall opening.

* * * * *